United States Patent [19]

Mitsuhashi et al.

[11] Patent Number: 4,626,487

[45] Date of Patent: Dec. 2, 1986

[54] PARTICULATE DEVELOPER CONTAINING INORGANIC SCRAPER PARTICLES AND IMAGE FORMING METHOD USING THE SAME

[75] Inventors: Yasuo Mitsuhashi, Yokohama; Masaki Uchiyama; Kazunori Murakawa, both of Tokyo; Kenji Okado, Yokohama, all of Japan

[73] Assignee: Canon Kabushiki Kaisha, Tokyo, Japan

[21] Appl. No.: 634,060

[22] Filed: Jul. 25, 1984

[30] Foreign Application Priority Data

Aug. 3, 1983 [JP] Japan ..... 58-142061
Dec. 26, 1983 [JP] Japan ..... 58-249087

[51] Int. Cl.[4] ..... G03G 9/00; G03G 9/14; G03G 13/06

[52] U.S. Cl. ..... 430/109; 430/106.6; 430/110; 430/111

[58] Field of Search ..... 430/110, 111, 106.6, 430/109

[56] References Cited

U.S. PATENT DOCUMENTS

| | | | |
|---|---|---|---|
| 2,919,247 | 12/1959 | Allen | 430/110 |
| 3,165,420 | 1/1965 | Tomanek et al. | 430/110 |
| 3,400,000 | 9/1968 | Hoffman | 430/110 |
| 3,554,778 | 1/1971 | Granzow | 430/111 |
| 4,125,667 | 11/1978 | Jones | 430/106.6 |
| 4,179,388 | 12/1979 | Rahn et al. | 430/111 X |
| 4,264,698 | 4/1981 | Takayama et al. | 430/110 X |
| 4,301,228 | 11/1981 | Kori et al. | 430/110 X |
| 4,465,754 | 8/1984 | Kuin et al. | 430/110 X |
| 4,482,621 | 11/1984 | Kashiwagi | 430/111 X |

*Primary Examiner*—John Kittle
*Assistant Examiner*—Mukund J. Shah
*Attorney, Agent, or Firm*—Fitzpatrick, Cella, Harper & Scinto

[57] ABSTRACT

A developer comprising colored resinous particles and inorganic fine particles having a BET specific surface area of 0.2 to 30 $m^2/g$ as measured by nitrogen adsorption. The inorganic fine particles have an action of promoting removal of paper powder and other adherents during cleaning of the latent image-bearing member without sticking onto the latent image-bearing member. Accordingly, the developer containing the inorganic fine particles can give good images even after successive copying operation for a long term.

15 Claims, 1 Drawing Figure

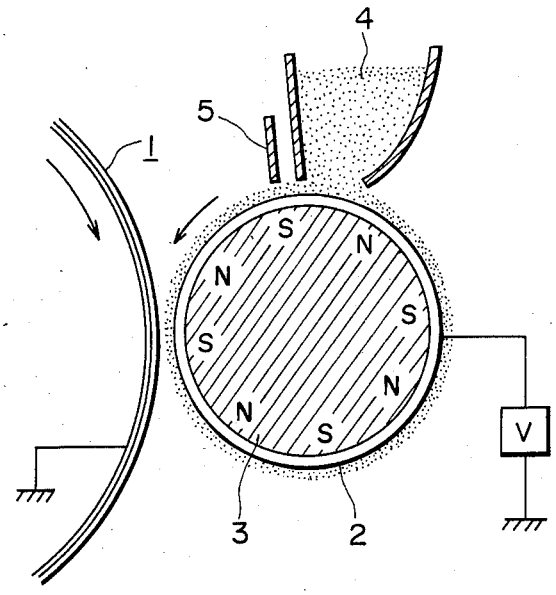
4
5
1
S
N
N
S
S
N
N
S
V
3
2

PARTICULATE DEVELOPER CONTAINING INORGANIC SCRAPER PARTICLES AND IMAGE FORMING METHOD USING THE SAME

BACKGROUND OF THE INVENTION

This invention relates to a novel developer adapted to electrophotography, electrostatic recording, magnetic recording, etc., and an image forming method using the same.

In electrophotography, an electrostatic latent image is first formed through utilization of the photoconductors such as cadmium sulfide, polyvinylcarbazole, selenium, zinc oxide, etc., for example, by uniformly imparting charges on a photoconductor layer, and by applying an imagewise exposure to the photoconductor. The electrostatic latent image is developed with a powdery toner or developer charged to the opposite polarity to that of the electrostatic latent image and, if desired, the developed image is further transferred to a transfer sheet, followed by fixing.

Of these processes, especially in the case of a device having the transfer step, it is generally practiced to remove the residual toner on the photosensitive member not transferred and use the photosensitive member repeatedly.

For removing the residual toner on the photosensitive member, a cleaning member is generally brought into contact with the photosensitive member as practiced in the blade cleaning system, the fur brush cleaning system or the magnetic brush cleaning system. In this case, the cleaning member contacts the photosensitive member under an appropraite pressure, and therefore the photoconductive member may be damaged or the toner may stick onto the photosensitive member. In order to avoid sticking of the toner onto the photosensitive member, it has been proposed to add both a waxy friction-reducing material and an abrasive material into the toner, as disclosed in Japanese Laid-Open Patent Application No. 47345/1973. This method is indeed effective for avoiding sticking of toner, but involves the following drawback. That is, when a friction-reducing material is added in an amount enough to avoid toner sticking, it will become difficult to remove materials with low electric resistance such as paper powder, ozone-oxidation product, etc. formed on or sticking onto the surface of the photosensitive member after repeated uses. In particular, in an environment of high temperature and high humidity, a defect is observed that the latent image on the photosensitive member is damaged by the materials with low electric resistance.

Also, it is difficult to control the amounts of the friction-reducing material and the abrasive material to be added, and therefore difficult to obtain a developer having stable characteristics. If the abrasive material is added in an amount sufficient to remove the sticking onto the photosensitive member, some troubles may be caused, such as damaging of the photosensitive member or damaging of the cleaning blade, whereby cleaning cannot satisfactorily be performed.

SUMMARY OF THE INVENTION

An object of the present invention is to provide a developer free of the drawbacks as mentioned above, namely which scarcely sticks onto the surface of the photosensitive material while giving little damage to the photosensitive member and the cleaning member during cleaning.

Another object of the present invention is to provide an image forming method using such a developer as mentioned above.

The developer of the present invention comprises colored resinous particles and inorganic fine particles (A) having a BET specific surface area of 0.2 to 30 $m^2/g$ as measured by nitrogen adsorption.

The image forming method of the present invention comprises developing a latent image on a latent image-bearing member with the above developer, transferring the developed image formed to a transfer material and removing the residual developer on the latent image-bearing member.

BRIEF DESCRIPTION OF THE DRAWING

The accompanying drawing is a sectional view illustrating an embodiment of the developing step of the image forming method according to the present invention.

DETAILED DESCRIPTION OF THE INVENTION

The inorganic fine particles having a BET specific surface area of 0.2 to 30 $m^2/g$ as measured by nitrogen adsorption to be used in the present invention (hereinafter referred to as "inorganic fine particles A") have the function of scraping off the materials with low electric resistance such as paper powder, ozone-oxidation product etc., and the toner sticking onto the surface of the photosensitive member. Particularly, the inorganic fine particles A form minute unevenness on the photosensitive surface, thereby effectively acting to alleviate the frictional resistance between the photosensitive surface and the cleaning member and prevent the sticking of toner. For this purpose, the inorganic fine particles A are also required to be harder than the photosensitive surface, particularly preferably to have a Mohs hardness greater than talc (Mohs hardness $=1$). Further, the inorganic particles A should preferably be shaped with round corners, since shapes with sharp corners may cause damaging of the photosensitive member and the cleaning blade. In this respect, the inorganic particles A should preferably be those formed by sintering. "Sintering" mentioned herein means an operation to heat the particles at a temperature not higher than the melting point thereof thereby to melt only the vicinity of the surfaces and agglomerate the particles, thereby forming bondings between the particles with substantially the same strength as in the internal portions. The shapes of the particles formed according to the sintering method have a morphological characteristic that they are rather round than having sharp corners. Such a morphological characteristic can also be maintained when a sintered product of wet or dry compressed particles or a sintered agglomerate is crushed to a desired particle size or specific surface area.

The inorganic fine particles A should preferably be not readily soluble in water in order that the charging characteristics of the developer may not be lowered in an environment of high temperature and high humidity. More specifically, it is possible to use iron oxide, chromium oxide, calcium titanate, strontium titanate, barium titanate, magnesium titanate, cerium oxide, zirconium oxide, aluminum oxide, titanium oxide, zinc oxide and the like. These compounds can be used either singly or in mixture.

The inorganic particles A have a BET specific surface area of 0.2 to 30 $m^2/g$ as measured by nitrogen adsorption. This is because desired effects cannot be obtained outside of this range. The inorganic particles A should desirably have a BET specific surface area of 0.5 to 15 $m^2/g$, particularly preferably 1.0 to 6.0 $m^2/g$. The specific surface area as measured by nitrogen adsorption in the present specification is based on the values measured under the prescribed conditions by means of a commercially available device (Model 2200, produced by Micromeritics Co.), with proviso that the amount of sample was reduced in the case when the specific surface area exceeded 200 $m^2/g$.

The above described inorganic fine particles A may be added in an amount preferably of 0.1 to 30 % by weight, more preferably of 0.2 to 10 % by weight, based on the total amount of the toner.

Further, the inorganic fine particles A may be subjected to an organic treatment of the surfaces with the use of a known coupling agent.

It is preferred to use finer inorganic particles having a BET specific surface area as measured by nitrogen adsorption of 40 to 400 $m^2/g$, preferably 50 to 350 $m^2/g$, particularly preferably 70 to 300 $m^2/g$ (hereinafter referred to as "inorganic fine particles B") in combination with the inorganic particles A. In this case, the inorganic fine particles A should preferably have a BET specific surface area of 0.5 to 350 $m^2/g$. The inorganic fine particles B have also the function to scrape off the materials with low electric resistance such as paper powder, ozone-oxidation product, etc., and the toner sticking onto the photosensitive surface. However, couse of the inorganic particles B may be considered to exhibit excellent effect, because they have a specific effect of removing minute adherents on the photosensitive surface. The inorganic particles B are also preferably not readily soluble in water, and may include, for example, iron oxide, magnesium oxide, siliceous powder, etc. It is also possible to use fine silica particles produced by the dry process and the wet process.

The dry process herein mentioned refers to a process for production of fine silica particles formed by the vapor phase oxidation of silicon halides. For example, it is a process utilizing the pyrolytic oxidation in oxygen-hydrogen flame of silicon tetrachloride gas, and the basic reaction scheme may be represented as follows:

$$SiCl_4 + 2H_2 + O_2 \rightarrow SiO_2 + 4HCl.$$

Also, in this preparation step, it is possible to obtain a composite fine powder of silica and metal oxides by use of other metal halides such as aluminum chloride or titanium chloride together with the silicon halides, and such embodiments are also included within the present invention.

On the other hand, various known processes are applicable as the wet process. For example, there may be included the method according to decomposition of sodium silicate with an acid as generally shown by the following reaction scheme:

$$Na_2O.XSiO_2 + HCl + H_2O \rightarrow SiO_2.nH_2O + NaCl$$

or otherwise according to decomposition of sodium silicate with an ammonium salt or an alkali salt (hereinafter reaction schemes are omitted); the method wherein an alkaline earth metal silicate is formed from sodium silicate and decomposed with an acid, to form silicic acid; the method wherein a sodium silicate solution is converted with an ion-exchange resin into silicic acid; or the method in which natural silicic acid or silicate is utilized.

For the fine siliceous particles herein mentioned, anhydrous silicon dioxide (silica) or otherwise any of silicates such as aluminum silicate, sodium silicate, potassium silicate, magnesium silicate, zinc silicate and the like may be applicable.

The inorganic fine particles B including fine siliceous particles, should preferably be subjected to organic treatment of their surfaces such as the coupling treatment, the oil treatment or treatment with a fatty acid or a metal salt thereof.

The inorganic fine particles B should preferably be employed in an amount of 0.01 to 20 % by weight, more preferably 0.03 to 5 % by weight, based on the total amount of the toner (namely, the total amount of the colored resinous particles and the inorganic particles A and B).

These fine particles A and B should preferably exist in the form of being attached on the surfaces of the toner particles, namely the colored resinous particles. More preferably, the attachment should be a rather weak or triboelectric one as given by dry blending than by melt-blending.

The colored resinous particles constituting the developer of the present invention in combination with the above inorganic fine particles A and the inorganic fine particles B (when used) comprise a binder resin and a colorant.

The binder resin may be composed of homopolymers or copolymers of styrene and derivatives thereof such as polystyrene, poly-p-chlorostyrene, polyvinyltoluene, styrene-p-chlorostyrene copolymer, styrene-vinyltoluene copolymer; styrene-acrylate copolymers such as styrene-methyl acrylate copolymer, styrene-ethyl acrylate copolymer, styrene-n-butyl acrylate copolymer; styrene-methacrylate copolymers such as styrene-methyl methacrylate copolymer, styrene-ethyl methacrylate copolymer, styrene-n-butyl methacrylate copolymer; multi-component copolymers of styrene, acrylates and methacrylates; other copolymers of styrene with vinyl monomers such as styrene-acrylonitrile copolymer, styrene-vinyl methyl ether copolymer, styrene-vinyl ethyl ether copolymer, styrene-butadiene copolymer, styrene-vinyl methyl ketone copolymer, styrene-acrylonitrile-indene copolymer, styrene-maleic acid ester copolymer, etc.; polymethyl methacrylate, polybutyl methacrylate, polyvinyl acetate, polyester, polyamide, epoxy resin, polyvinyl butyral, polyacrylic acid resin, phenol resin, aliphatic or alicyclic hydrocarbon resin, petroleum resin, chlorinated paraffin, paraffin wax, etc. These binder resins may be used either singly or as a mixture. In particular, as the binder resin for the toner to be provided for use in the pressure fixing system, it is possible to use a low molecular weight polyethylene, a low molecular weight polypropylene, an ethylene-vinyl acetate copolymer, an ethylene-acrylate copolymer, a higher fatty acid, a polyamide resin, a polyester resin, etc. either singly or as a mixture.

In the developer of the present invention, any known pigment or dye may be available as the colorant. For example, there may widely be used dyes and pigments such as carbon black, phthalocyanine blue, indanthrene blue, peacock blue, permanent red, lake red, rhodamine lake, hanza yellow, permanent yellow, benzidine yellow, etc.

In order to use the toner of the present invention in the form of a magnetic toner, magnetic powder may also be incorporated therein. The magnetic powder to be incorporated in the toner may be of a material which is magnetized when placed in a magnetic field, including powder of a ferromagnetic metal such as iron, cobalt or nickel, or alloys thereof, or compounds such as magnetite, hematite, or γ-iron oxide ferrite. The magnetic powder also functions as a colorant and is contained in an amount of 15 to 70 wt.% based on the total amount of the so called toner components, excluding the carrier as hereinafter described.

The developer of the present invention can be further mixed with other additives, if desired, as far as they do not impair the characteristics of the toner. Such additives may include agents for imparting free flowing property such as colloidal silica, lubricants such as Teflon, zinc stearate, polyvinylidene fluoride, or fixing aids (e.g. low molecular weight polyethylene, low molecular weight polypropylene, etc.) and further conductivity imparting agents such as tin oxide.

In preparation of the developer of the present invention, any desired method may be applicable. For example, the above constituent materials may be well kneaded by means of a thermal kneading machine such as hot roll, kneader, extruder, etc., followed by mechanical crushing and classification. Alternatively, materials such as magnetic powder are dispersed in a solution of a binder resin, followed by spray drying. It is also possible to apply the toner preparation method according to polymerization technique by mixing necessary materials with the monomers for constituting the binder resin and then polymerizing the emulsion or suspension of the resultant mixture to obtain a toner.

The developer of the present invention comprising the so called toner components as described above, if desired, can be used in the form of a mixture with carrier particles such as iron powder, glass beads, nickel powder, ferrite powder, etc. to be used as a developer for electrostatic latent images.

The image forming method of the present invention comprises developing the latent image on a latent image bearing member with the use of the developer as described above, transferring the developed image formed to a transfer material and removing the residual developer on the latent image-bearing member.

The latent image-bearing member to be utilized include photosensitive or insulating materials suitable for formation and holding of electrical latent images thereon, for example, those having organic polymer layer on the surface, photosensitive materials such as organic photoconductive material (OPC), amorphous Se, amorphous Si, zinc oxide, etc. In particular, one having an organic polymer layer on the surface and an amorphous silicon photosensitive material are preferred.

The developer of the present invention is applicable to various developing methods. For example, it is applicable to the magnetic brush developing method, the cascade developing method, the method as disclosed in U.S. Pat. No. 3,909,258 in which conductive magnetic toner is used, the method as disclosed in Japanese Laid-Open Patent Application No. 31136/1978 in which high resistivity magnetic toner is used, the methods as disclosed in Japanese Laid-Open Patent Applications Nos. 42121/1979, 18656/1980 and 43027/1979, the fur brush developing method, the powder cloud method, the touch down developing method, the impression developing method, and others.

For transfer of the image developed with the developer of the present invention to a transfer material such as plain paper, the known methods such as corona transfer, bias roll transfer, heat transfer, magnetic transfer, etc. may be applied.

For removing the residual developer on the photosensitive or insulating material, it is possible to apply known methods such as the blade cleaning method, the fur brush cleaning method, the magnetic brush cleaning method, etc. However, as is apparent from the foregoing explanation, the developer of the present invention has characteristics particularly adapted to the blade cleaning method.

Further, fixing of the developer of the present invention onto a transfer member may be carried out according to any of the known methods such as oven fixing, hot roll fixing, pressure fixing, flush fixing, microwave fixing, etc.

The present invention is further illustrated by referring to Preparation Examples for preparation of the inorganic particles A of the present invention, and Examples concerning preparation and evaluation of the developer using such inorganic particles A. In the following description, all "parts" and "parts by weight".

PREPARATION EXAMPLE 1

In a ball mill, 147.6 g of strontium carbonate and 79.9 g of titanium oxide were subjected to wet mixing for 8 hours, and then the mixture was subjected to filtering and drying. Twenty grams (20 g) of this mixture was molded under a pressure of 5 kg/cm$^2$, followed by calcination at 1100 ° C. for 8 hours to cause sintering. Then, the sintered product was mechanically crushed into fine particles of strontium titanate with a BET specific surface area of 2.4 m$^2$/g.

PREPARATION EXAMPLE 2

Twenty grams (20 g) of zirconium hydroxide were molded under a pressure of 50 kg/cm$^2$ and calcined at 1800 ° C. for 8 hours to cause sintering. Then, the sintered product was mechanically crushed into zirconium oxide with a BET specific surface area of 2.0 m$^2$/g.

PREPARATION EXAMPLE 3

After wet mixing of 197.3 g of barium carbonate with 79.9 g of titanium oxide in a ball mill, the resultant mixture was subjected to filtering and drying. Twenty grams (20 g) of the mixture was molded under a pressure of 5 kg/cm$^2$and calcined at 1200 ° C. for 8 hours. Then, mechanical crushing was effected to produce barium titanate particles with a BET specific surface area of 3.0 m$^2$/g.

PREPARATION EXAMPLE 4

Chromium hydroxide in an amount of 20 g was molded under a pressure of 5 kg/cm$^2$ and calcined at 1300 ° C. for 6 hours to cause sintering. The sintered product was mechanically crushed to produce chromium oxide particles with a BET specific surface area of 2.4 m$^2$/g.

PREPARATION EXAMPLE 5

In a ball mill, 100.8 g of calcium carbonate and 71.7 g of titanium oxide were wet-blended, and the mixture was subjected to filtering and drying. Twenty grams (20 g) of the mixture was molded under a pressure of 5 kg/cm$^2$, calcined at 1350 ° C. for 6 hours, and mechanically crushed to produce calcium titanate having a BET specific surface area of 1.9 m$^2$/g.

PREPARATION EXAMPLE 6

Zirconium hydroxide in an amount of 20 g was molded under a pressure of 5 kg/cm$^2$, calcined at 2000 ° C. for 10 hours, and mechanically crushed to produce zirconium oxide particles with a BET specific surface area of 6.7 m$^2$/g.

PREPARATION EXAMPLE 7

Cerium carbonate in an amount of 20 g was molded under a pressure of 5 kg/cm$^2$, calcined at 1600 ° C. for 10 hours, and thereafter mechanically crushed to produce cerium oxide particles with a BET specific surface area of 9.6 m$^2$/g.

EXAMPLE 1

Styrene-butadiene copolymer (weight ratio: 84:16): 90 parts
Styrene-dimethylaminoethyl methacrylate copolymer (weight ratio 90:10): 10 parts
Low molecular weight polyethylene: 5 parts
Magnetite: 60 parts The above materials were well blended and then melt-kneaded on a roll mill. After cooling, the mixture was coarsely crushed by a hammer mill, pulverized by means of a jet micropulverizer and further subjected to classification by use of a wind force classifier to obtain colored resinous particles of 5 to 20 microns in diameter. One hundred (100) parts of the colored resinous particles were blended with 1.5 parts of the fine powder of strontium titanate with a specific surface area of 2.4 m$^2$/g formed in Preparation Example 1 and 0.5 part of colloidal silica (specific surface area 90 m$^2$/g) to prepare a toner.

On the other hand, an electrostatic latent image was formed on an OPC photosensitive member 1 having a surface layer of a methyl methacrylate copolymer and the above toner was applied to a developing device as shown in the drawing to effect development. The developer carrying member was made of a stainless steel cylindrical sleeve 2 with an outer diameter of 50 mm. The surface magnetic flux density on the sleeve 2 was 700 Gauss, and the distance between the toner thickness-regulating blade 5 and the sleeve surface was 0.25 mm. The developing device having the rotating sleeve 2 and a fixed magnet 3 (sleeve circumferential speed being 66 mm/sec and the same as that of the drum, with an opposite rotational direction) was set to give a distance of 0.25 mm between the surface of the above photosensitive drum 1 and the surface of the sleeve 2, and an alternate current of 1600 Hz and 1400 V and a direct current bias of −150 to −300 V were applied to the sleeve.

The above toner 4 was applied to this developing device to develop the above latent image, then the powder image was transferred while irradiating a direct current corona of −7 KV on the back of a transfer paper to obtain a copied image. Fixing was performed by means of a fixing device of a commercially available plain paper copying machine (trade name: NP-200, produced by Canon K.K.). The residual toner on the photosensitive member was removed by use of a blade cleaning system. The blade cleaning system comprised a blade of a polyurethane plate which was set at a counterwise position with respect to the rotating direction of the photosensitive drum and held to give a stationary pressure of 5 – 20 g/cm against the photosensitive drum.

As a result of the above practice, clear images without fog could be obtained. Also, when successive copying test was conducted for 3,000 sheets, respectively, in environments of normal temperature-normal humidity (20 ° C., 60 %), low temperature-low humidity (15 ° C., 10 %) and high temperature-high humidity (30 ° C., 90 %), good images could be obtained in any of the environments, without occurrence of disturbance of the image or fog through toner sticking onto the surface of the photosensitive member.

EXAMPLE 2

Styrene-butyl acrylate copolymer (70/30): 100 parts
Magnetite: 60 parts
Nigrosine dye: 2 parts
Low molecular weight polyethylene: 5 parts By use of the above materials, colored resinous particles of 5 to 20 microns in diameter were obtained similarly as in Example 1. One hundred (100) parts of the colored resinous particles were mixed with 1 part of zirconium oxide with a specific surface area of 2.0 m$^2$/g obtained in Preparation Example 2 and 0.4 part of colloidal silica (specific surface area 90 m$^2$/g) to prepare a toner. This toner was employed similarly as described in Example 1 to give similarly good results.

EXAMPLE 3

Styrene-butyl acrylate copolymer (70/30): 100 parts
Magnetite: 60 parts
Gold-containing dye (Zapon Fast Black B): 2 parts
Low molecular weight polypropylene: 3 parts By use of the above materials, colored resinous particles of 5 to 20 microns were obtained similarly as in Example 1. One hundred (100) parts of the colored resinous particles were mixed with 1 part of barium titanate with a specific surface area of 3.0 m$^2$/g obtained in Preparation Example 2 and 0.4 part of colloidal silica (specific surface area 200 m$^2$/g) to prepare a toner. This toner was applied to a commercially available copying machine (NP-400 RE,, produced by Canon K.K.), and successive copying test was performed for 10,000 sheets in respective environments of normal temperature-normal humidity, low temperature-low humidity and high temperature-high humidity. Good results could be obtained from the beginning to the end in any of these cases.

COMPARATIVE EXAMPLE 1

Example 1 was repeated except that no strontium titanate prepared in Preparation Example 1 was employed. As the result, when successive copying test was conducted under high temperature and high humidity conditions, flaw-like irregularities occurred in the image after 1,000 sheets of copying, while marked toner sticking occurred after 3,000 sheets of copying under the low temperature and low humidity conditions.

EXAMPLE 4

A toner was prepared in the same manner as in Example 1 except for employing fine chromium oxide particles with a specific surface area of 2.4 m$^2$/g in place of 1.5 part of the fine strontium titanate particles in Example 1. When successive copying test was conducted in the respective environments of normal temperature-normal humidity, low temperature-low humidity and high temperature-high humidity, good results substantially the same as in Example 1 could be obtained.

When the colloidal silica with a specific surface area of 90 $m^2/g$ synthesized according to the wet process was replaced with colloidal silica having specific surface area of 100 $m^2/g$, 170 $m^2/g$ and 210 $m^2/g$, respectively, synthesized according to the dry process, followed by treatment with an amine-modified silicone oil, good results were also obtained without occurrence of disturbance of image or fog through sticking of the toner onto the surface of the photosensitive member.

EXAMPLE 5-8

Preparation of toners and successive copying test were repeated according to substantially the same procedure as in Example 4, except that 2 parts of calcium titanate with a specific surface area of 1.9 $m^2/g$, 1.5 parts of zirconium oxide with a specific surface area of 6.7 $m^2/g$, 1 part of strontium titanate with a specific surface area of 2.0 $m^2/g$ and 0.8 part of cerium oxide (purity: 70 %) with a specific surface area of 9.6 $m^2/g$ were employed, respectively, in place of the chromium oxide in Example 4. In every case, good results could be obtained similarly as in Example 4.

EXAMPLE 9

Example 3 was repeated except for substituting fine chromium oxide particles having a specific surface area of 2.4 $m^2/g$ for the barium titanate to obtain a toner. As the result of successive copying test for 10,000 sheets, good results could be obtained similarly as in Example 3.

EXAMPLE 10

The toner of Example 3 was applied to a developing device as shown in the attached drawing having an amorphous silicon photosensitive member on which a latent image of +420 V was formed. The structure of the developing device was similar to that used in Example 1 but different conditions were adopted, i.e., a drum circumferential speed of 350 mm/sec, an alternating current of 1400 V and 1700 Hz and a direct current bias of 100 to 150 V applied to the sleeve. After the development, the resultant toner image was transferred while irradiating a direct current corona of 7 KV on the back of a transfer paper to obtain a copied image on the transfer sheet. Fixing was performed by means of a fixing device of a commercially available copying machine (NP-400 RE, produced by Canon K.K.). The residual toner on the photosensitive member was removed by use of the blade cleaning system as explained in Example 1.

Successive copying test was coducted for 10000 sheets under the high temperature and high humidity conditions, whereby no disturbance of image or fog due to sticking of toner onto the photosensi-tive member was observed.

EXAMPLE 11

Styrene-butadiene copolymer: 80 parts
Styrene-diethylaminoethyl methacrylate copolymer: 20 parts
Magnetite: 55 parts Colored resinous particles of 5 to 20 microns in diameter were produced in substantially the same manner as in Example 1 except for using the above materials. The colored resinous particles in an amount of 100 parts were mixed with 1.5 parts of the strontium titanate particles of Preparation Example 1 produced through the sintering method and having a BET specific surface area of 2.4 $m^2/g$, to produce a toner.

Imaging and heat fixing were performed by using a toner to obtain good images. As the result of successive copying test under the high temperature and high humidity conditions, no irregularity observed on copying 1000 sheets, while slight disturbance of image was observed on copying 3000 sheets.

EXAMPLES 12 and 13

Example 11 was substantially repeated except for using the zirconium oxide of Preparation Example 2 and the barium titanate of Preparation Example 3, respectively, in place of the strontium titanate of Preparation Example 1, whereby substantially the same results as in Example 11 were obtained.

EXAMPLE 14

Example 11 was repeated except for using cerium oxide particles having a specific surface area of 15 $m^2/g$ produced without sintering in place of the strontium titanate of Preparation Example 1, whereby slight flaw was observed but no disturbance of image was observed on copying of 1000 sheets, while disturbance of image was observed on copying of 3000 sheets.

COMPARATIVE EXAMPLE 2

Example 11 was substantially repeated except for using cerium oxide having a specific surface area of 50 $m^2/g$ in place of the strontium titanate in Preparation Example 1, whereby disturbance of image was observed on copying of 1000 sheets.

COMPARATIVE EXAMPLE 3

Example 11 was substantially repeated except for using strontium titanate having a specific surface area of 42 $m^2/g$ produced by the wet process in place of the strontium titanate of Preparation Example 1, whereby disturbance of image was observed on copying of 1000 sheets.

What is claimed is:

1. A particulate developer, which comprises
(i) 85 to 99.77% by weight of colored resinous particles,
(ii) 0.2 to 10% by weight of inorganic fine particles (A) having a BET specific surface area of 0.2 to 30.0 $m^2/g$ as measured by nitrogen absorption, and
(iii) 0.03 to 5% by weight of inorganic fine particles (B) having a BET specific surface area of 40 to 400 $m^2/g$ as measured by nitrogen absorption, in which each weight of said particles is based on the total weight of said colored resinous particles, said inorganic fine particles (A), and said inorganic fine particles (B).

2. A particulate developer according to claim 1, wherein the colored resinous particles contain magnetic particles.

3. A particulate developer according to claim 1, wherein the inorganic fine particles (A) have a Mohs hardness greater than 1.

4. A particulate developer according to claim 3, wherein the inorganic fine particles (A) have been obtained through sintering.

5. A particulate developer according to claim 4, wherein the inorganic fine particles (A) have been crushed after sintering.

6. A particulate developer according to claim 1, wherein the inorganic fine particles (A) are strontium titanate or cerium oxide.

7. A particulate developer according to claim 1, wherein the inorganic fine particles (B) are siliceous powder.

8. An image forming method, which comprises developing a latent image on a latent image bearing member with a particulate developer, transferring the developed image formed to a transfer material and removing the residual developer on the latent image-bearing member, wherein said particulate developer comprises (i) 85 to 99.77% by weight of colored resinous particles, (ii) 0.2 to 10% by weight of inorganic fine particles (A) having a BET specific surface area of 0.2 to 30 $m^2/g$ as measured by nitrogen absorption, and (iii) 0.03 to 5% by weight of inorganic fine particles (B) having a BET specific surface area of 40 to 400 $m^2/g$ as by nitrogen absorption, in which each weight of said particles is based on the total weight of said colored resinous particles, said inorganic fine particles (A), and said inorganic fine particles (B).

9. An image forming method according to claim 8, wherein the inorganic fine particles (A) have a Mohs hardness greater than 1.

10. An image forming method according to claim 9, wherein the inorganic fine particles (A) have been obtained through sintering.

11. An image forming method according to claim 8 wherein said latent image-bearing member comprises an organic photoconductive material.

12. An image forming method according to claim 8, wherein said latent image-bearing member is an amorphous silicon photosensitive member.

13. An image forming method according to claim 8, wherein the residual developer on the latent image-bearing member is removed by scraping with a cleaning blade.

14. A particulate developer according to claim 1, wherein the inorganic fine particles (A) comprise strontium titanate and the inorganic fine particles (B) comprise colloidal silica.

15. A particulate developer according to claim 1, wherein the inorganic fine particles (A) comprise cerium oxide and the inorganic fine particles (B) comprise colloidal silica.

* * * * *